United States Patent [19]

Pascoe

[11] 4,437,632

[45] Mar. 20, 1984

[54] RESET APPARATUS FOR RAILROAD TRACK CIRCUITS

[75] Inventor: Robert D. Pascoe, Upper St. Clair Township, Allegheny County, Pa.

[73] Assignee: American Standard Inc., Swissvale, Pa.

[21] Appl. No.: 352,424

[22] Filed: Feb. 25, 1982

[51] Int. Cl.[3] ..... B61L 21/00

[52] U.S. Cl. ..... 246/34 R; 246/34 B; 246/34 A; 246/63 R

[58] Field of Search ..... 246/34 R, 34 CT, 34 A, 246/34 B, 63 R, 63 A, 63 C, 167 R

[56] References Cited

U.S. PATENT DOCUMENTS

| | | | |
|---|---|---|---|
| 1,653,358 | 12/1927 | Gilson | 246/34 A |
| 1,810,940 | 6/1931 | Baughman | 246/34 A |
| 1,822,088 | 9/1931 | Hailes | 246/34 R |
| 3,263,074 | 7/1966 | Ihrig | 246/34 R |

*Primary Examiner*—James J. Groody

*Attorney, Agent, or Firm*—A. G. Williamson, Jr.

[57] ABSTRACT

The two inputs of a first flip-flop (FF) are alternately energized over a pair of opposite contacts of a code transmitter. Outputs of a second FF alternately enable a pair of logic gates to pass first or second output pulses of the first FF as clock pulses which drive a counter which produces an output pulse after each preselected count X. Each counter output pulse, equal in length to a half cycle of the code, triggers the second FF to its opposite state. A magnetic stick code repeater relay is driven between its two positions by energy supplied from a normally active driver circuit over another pair of opposite contacts of the code transmitter. The driver circuit is optically coupled to be turned off during each counter output pulse, thus inhibiting repeater relay operation during the corresponding half code cycle. This relay holds in its existing position, blanking a half cycle code period, and then is held by the again active driver circuit during the subsequent half cycle. The repeater relay codes the energy supplied to an AC track circuit during train occupancy. When the train clears, the vane type track relay is not responsive to coded energy. However, the long energy period resulting when the repeater relay holds position is sufficient to pick up the track relay to reset the track circuit to normal steady energy condition.

8 Claims, 2 Drawing Figures

RESET APPARATUS FOR RAILROAD TRACK CIRCUITS

RELATED APPLICATION

Heinz Gilcher, U.S. Ser. No. 295,197, filed Aug. 21, 1981, for Code Reset Apparatus for Railroad Track Circuits.

FIELD OF THE INVENTION

My invention pertains to code reset apparatus for railroad track circuits. More particularly, the invention relates to a circuit arrangement and apparatus which reenergizes a vane type alternating current track relay to register an unoccupied track section when coded energy initially flows through the rails after clearance by a train.

BACKGROUND OF THE INVENTION

Normally alternating current (AC) track circuits using vane type relays as track relays are energized by steady energy, both the track and local windings. In some installations, such track circuits also provide coded AC energy in the rails when a train occupies the section to control cab signal and/or other train carried apparatus. Under certain operating situations, e.g., when a train backs out of the section or a temporary shunt is removed, the track circuit must reset to its normal at-rest, steady energy condition from the coded track energy condition. This requires the vane relay to receive sufficient energy to at least open its back contacts, to release the cab signal energy control relay. One way to assure this level of energization is to increase the local and/or track supply voltages when a train occupies the section. This is acceptable where a standard track shunting sensitivity is used, i.e., track circuit detects a minimum 0.06 ohm train shunt. However, some systems use higher shunt levels, e.g., 0.5 ohm shunting sensitivity. Under such higher limits, increasing the local or track voltage levels for reset is not possible, since this reduces shunting sensitivity to the point that the track relay may not detect the train shunt if it decreases to near the selected minimum level. System safety then suffers. It has been found that a conventional vane type track relay will respond to lower track code rates, e.g., 50 or 75 pulses per minute, but will not receive sufficient energy to open back contacts at higher rates, e.g., 180, 270, 420 pulses per minute, i.e., 3, 4.5, and 7 Hz. Some additional arrangement must therefore be used to assure reset of the track circuit to steady energy.

Accordingly, an object of my invention is a circuit arrangement which assures the reset of an AC track circuit to a steady energy condition following a period of coded rail energy.

Another object of the invention is apparatus for an AC track circuit using a vane type track relay to assure reset of the track circuit and relay from a coded track energy condition to a steady energy condition.

It is also an object of the invention to provide, in a normally steady energy AC track circuit, a pulse filler network at the transmitter location which periodically fills in, with transmitted energy, an off-period of the coded energy transmitted through the rails when a train occupies the section, to sufficiently energize a vane type track relay, during the first such extended energy cycle after a train clears the section, to reset the track circuit to its steady energy state.

A further object of the invention is a code transmitter arrangement for an AC track circuit, which is actuated when a train occupies the section, and includes a logic network to periodically, at a selected time interval, fill in a code off-time period to assure sufficient energization of the track relay after a train clears to reset the track circuit to its normal, at-rest steady energy condition.

Yet another object of my invention is a pulse filler arrangement which is coupled to the code transmitter of an AC track circuit, actuated when a train occupies the section for driving a magnetic stick relay to vitally code the AC energy applied to the rails at a preferred duty cycle to provide cab signal control energy, and which periodically holds that stick relay in position to fill a normal code off-time with transmitted energy to sufficiently energize the track relay to reset the track circuit to its steady energy condition.

A still further object of the invention is an AC track circuit arrangement, normally steadily energized and in which coded track energy is substituted when a train occupies the track section, including a logic network, with a counter, actuated by a code transmitter to drive a magnetic stick relay to code the energy applied to the rails, the logic network responding to a selected count of the code pulses produced by the code transmitter to periodically ridge a code-off period to hold the magnetic stick relay in position to extend the code-on period to supply sufficient energy to pick up a vane type track relay after a train clears the section to reset the track circuit to its steady energy condition.

Other objects, features, and advantages of the invention will become apparent from the following specification and appended claims when taken in connection with the accompanying drawings.

SUMMARY OF THE INVENTION

The track circuit reset apparatus disclosed by this invention includes a basic pulse filler logic network which functions in the manner of a programmable mono-stable multivibrator. A pair of alternately closed contacts of a conventional track code transmitter drives a flip-flop element at the selected code rate so that its two outputs are alternately energized. In other words, each output alternates between the binary 1 and 0 states at the code rate but at opposite phase from the other. Alternately, through a pair of logic NAND circuits, one or the other output drives a counter device with a prefixed count X at which it generates an output signal. A second flip-flop element is actuated by the counter output pulse to change state at each prefixed count. That is, this flip-flop operates between its set and reset conditions so that its two outputs alternate, out of phase and at count rate X, between binary 1 and 0. The two flip-flop elements drive the pair of NAND gates which are alternately enabled by the second flip-flop in its set and reset conditions, respectively. Thus one gate responds to the pulses from one output of the first flip-flop when the second flip-flop is in its set condition and the other gate responds to the other output pulses of the first flip-flop when the second is in its reset condition. The two NAND gates alternately pulse or drive the counter unit which is preprogrammed to divide the pulse count by the selected divisor X. A counter output pulse is generated every Xth code pulse from the transmitter.

Another pair of alternately closed contacts of the code transmitter drive a magnetic stick code repeater relay between its two positions with energy supplied through a normally conducting driver transistor. When active, a contact of this stick relay codes the energy supplied to the rails for cab signal control. However, as specifically shown, steady AC energy is normally supplied to the rails over a back contact of a normally deenergized approach relay. When a train enters the section, release of the vane type track relay energizes this approach relay to activate the code transmitter and shift the track supply to include the code the code repeater relay contact. When the train clears, the vane type track relay does not normally respond to the coded rail energy, at least at higher rates, to open back contacts to release the approach relay to reset to steady energy. The output pulse of the counter, through a buffer network and optical coupler, turns off the driver transistor for the duration of the counter pulse, a period equal to a one-half cycle of the code rate. Synchronized by the other pair of transmitter contacts, this pulse action holds the code repeater relay to override an off period in the track code, thus extending the preceding energy on pulse to merge with the next energy on period. This extended energy pulse provides sufficient energy through the rails for the track relay to respond and open back contacts. This releases the approach relay and resets the track circuit to its steady energy condition.

BRIEF DESCRIPTION OF THE DRAWINGS

Before defining the invention in the appended claims, I will describe a specific circuit arrangement of the track circuit reset apparatus and its application in a railroad track circuit, both as illustrated in the accompanying drawings, in which:

In each of the drawings, the same or similar reference characters designate similar parts of the apparatus. At each location, a local direct current (DC) source supplies operating energy for the relays and other apparatus. Since any conventional DC energy source may be used, only the connections to its positive and negative terminals, designated B and N, respectively, are shown. Where necessary, e.g. FIG. 2, it is assumed that local DC sources are tied together as appropriate to provide return paths for the operating energy. A common source of AC energy for the track circuits is assumed with energy supplied to each location along the track by the wires designated in FIG. 2 as BX and NX.

DESCRIPTION OF THE ILLUSTRATED EMBODIMENT

Figure 1:
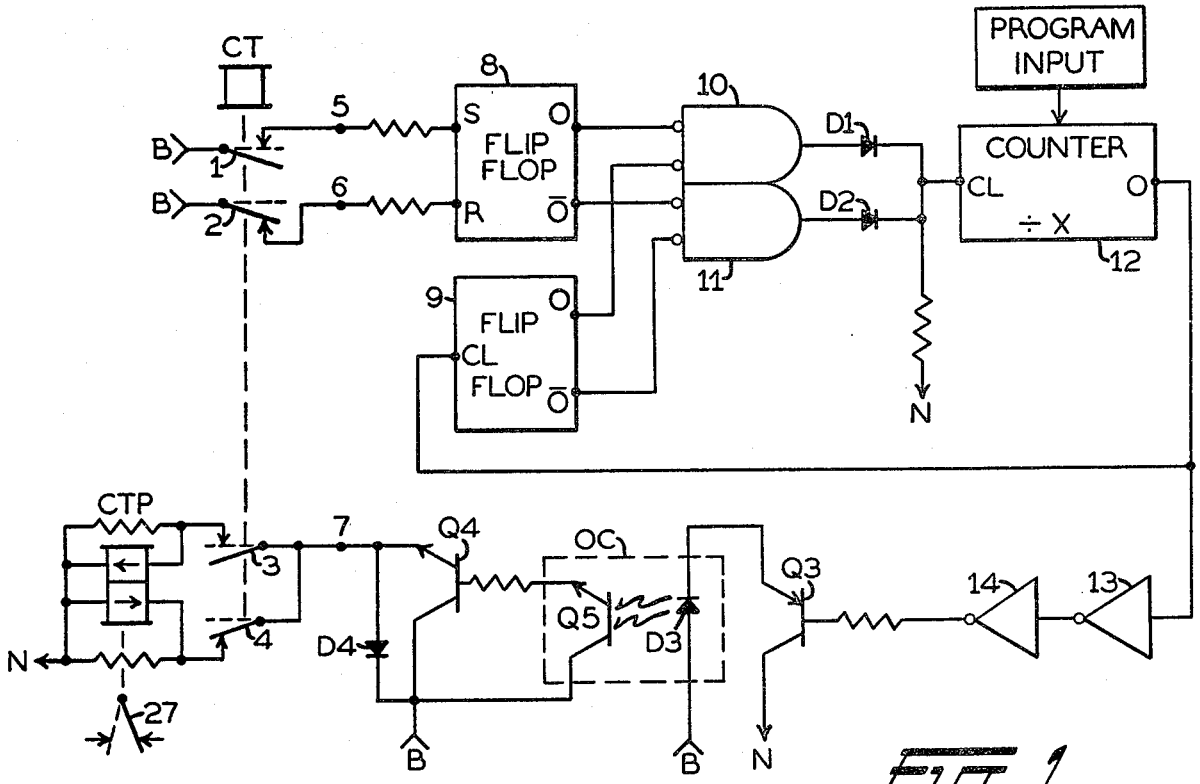
FIG. 1 is a schematic circuit diagram of code reset apparatus embodying the invention.

Referring to FIG. 1, a code transmitter device CT is shown in the upper left. Any known type may be used and the device is here illustrated as being of the relay type with four contacts 1, 2, 3, and 4. When transmitter CT is energized, which is assumed herein FIG. 1, each contact armature is periodically picked up and released at the selected code rate. Each armature is shown in its released position with a dashed line representation of its picked up position to indicate its coding action. The pair of contacts 1 and 2 are thus alternately closed during operation, each for substantially the same length of time. A code rate cycle thus includes successive closed periods of both contacts plus any transfer time. Only if some contact fault occurs will both contacts be closed simultaneously. The other pair of contacts 3 and 4 operate in a similar manner.

In the lower left of FIG. 1, a code transmitter repeater relay CTP is shown which is a two winding, magnetic stick type relay. When the upper winding is energized, contact armatures such as 27 are operated to close in the left-hand position, as designated by the arrow in the winding symbol. Conversely, when the lower winding is energized, the right-hand contacts are closed. When both windings are deenergized, the contacts remain in the position to which last operated. As will later be explained, energy from terminal B of the DC source normally appears on terminal 7 and, with transmitter CT active, is alternately applied over contacts 3 and 4 to the upper and lower windings of relay CTP. Current thus flows in turn through each winding to terminal N and contact 27 is operated to close left and right contacts at the code rate of device CT, each contact being closed for approximately one-half cycle of the code. It will also be noted that terminal B is alternately connected to terminals 5 and 6 by the operation of contacts 1 and 2 of device CT. The circuit elements to the right of terminals 5, 6, and 7 will normally be solid state or integrated circuit devices mounted on printed circuit boards. The terminals 5, 6, and 7 thus designate external connections to the basic code reset or pulse filler apparatus.

Contacts 1 and 2 of device CT alternately apply energy from terminal B to the set (S) and reset (R) inputs of a flip-flop (FF) element 8. The outputs O and $\bar{O}$ are thus alternately energized. Said in another way, each output of FF element 8 is alternately at binary 1 and 0 at the code rate, with these conditions occurring opposite or out of phase on the two out-puts. The flip-flop element serves to eliminate any effect of contact bounce, of contacts 1 and 2, on the operation of the reset apparatus. Outputs O and $\bar{O}$ of FF8 are applied, respectively, to one input of each of the NAND gates 10 and 11. The other input of each gate is received from the output O or $\bar{O}$ of second flip-flop element 9. Thus gate 10 or 11 is enabled to pass the output of element FF8 in accordance with the set or reset condition of element FF9. One or the other output signal from element FF8, i.e. a series of code pulses, is thus applied through diode D1 or D2 to the clock input CL of a counter device 12. These input signals occur at the code rate of device CT but periodically alternate, as element FF9 shifts, between representing the closing of contact 1 or contact 2.

While the counter 12 may take any known form, a specific example is a programmable down counter. That is, counter 12 counts down from a preset count and generates an output pulse at terminal O. As indicated, it divides the input clock pulses into blocks of X counts and produces the output at the end of each block count. Each output pulse has the width or duration of an input clock pulse and occurs at the code rate of device CT divided by X. Since different code rates may be used, the divisor X is selected by a program input module plugged into the counter to produce the desired output rate, e.g., a pulse every 30 seconds. The counter immediately resets, following an output pulse, to start the next count cycle. The output of counter 12 is applied, over one path, to the clock input CL of element FF9 which thus changes state at the end of each count period. This alternately enables gates 10 and 11, as previously described, so that, through element FF8, the counter alternately counts the closings of contacts 1 and 2.

The lower part of FIG. 1 shows the driver circuit network for relay CTP, which is controlled by counter 12. The output pulse from the counter is buffered into this driver network through inverters 13 and 14 and transistor Q3. An optical coupler OC, within the dashed block, isolates transistor Q3 from driver transistor Q4. Transistor Q3 is biased by the at-rest output of inverter 14 to be normally conducting. Current thus flows through the light emitting diode D3 of coupler OC so that light responsive transistor Q5 is also normally conducting. Transistor Q4 is then biased to its conducting condition so that energy from terminal B is applied to terminal 7. As previously described, as contacts 3 and 4 alternately close, the upper and lower windings of relay CTP are alternately energized and contact 27 is driven between its left and right positions, respectively.

Each output pulse from counter 12, in addition to triggering element FF9, turns off transistor Q3. With no current flowing in LED D3, transistor Q5 becomes non-conducting. This shuts off the positive bias on transistor Q4, which also becomes non-conducting to interrupt the supply of energy to terminal 7. This turn-off of transistor Q4 occurs at the time of position change of device CT contacts, back to front or vice-versa. In other words, each output pulse from counter 12 occurs at the eginning of the Xth clock pulse supplied from either gate 10 or 11. Since each counter output pulse has a full clock pulse width, i.e., is equal to the on or off period of the code rate of device CT, the absence of energy on terminal 7 matches the closed period of either contact 3 or 4, depending on the sequence in effect. The corresponding winding of relay CTP is not energized and this relay remains in the position to which last operated. Since the output pulse terminates at the end of the half cycle of the code rate, energy returns to terminal 7 when the opposite CT contact (3 or 4) again closes. The same winding last energized is now reenergized so that relay CTP holds in position for 1½ cycles of the code rate. A full pulse period, i.e., half cycle, of operation is thus blanked out.

In describing a typical operation of the apparatus of FIG. 1, it is assumed that output $\overline{O}$ of element FF9 is at binary 1. NAND gate 10 is thus enabled by the inverted output O of unit FF9. As CT contacts 1 and 2 alternately close, element FF8 produces alternate binary 1 and 0 signals on each output O and $\overline{O}$, at opposite phase. Gate 10 produces an output when FF8 output O is at binary 0 that a clock pulse is applied to input CL of counter 12 each time contact 1 is open and contact 2 closed. Assuming proper operation of device CT, these clock pulses are spaced by equal length off periods. At the beginning of the Xth clock pulse, counter 12 completes the programmed count and produces an output pulse at its terminal O. This output pulse, which occurs when contact 1 is open, is of equal length with a clock pulse, i.e., the closed period of contact 2. The counter immediately resets to prepare for another full count X. The output pulse triggers element FF9 so that its output O is now at binary 1 and, with output $\overline{O}$ at O, NAND gate 11 is enabled. Counter 12 immediately begins to count output $\overline{O}$ of unit FF8 so that the next clock pulse occurs when contact 2 opens, i.e., the next half cycle of code. When the next X count is completed, the output of counter 12 occurs with contact 2 open, that is, during the opposite half cycle of the code from device CT.

Meanwhile, since transistor Q4 is conducting, energy from terminal 7 is alternately applied to the windings of relay CTP by contacts 3 and 4. Relay CTP responds to alternately drive contact armature 27 to close left and right contacts. The first output pulse from counter 12, through inverters 13 and 14, turns off buffer transistor Q3. This turns off diode D3 which makes transistor Q5 non-conducting. With its bias removed, transistor Q4 turns off and energy is removed from terminal 7. Since the pulse occurs as device CT releases, contact 3 opens and contact 4 closes. No energy is applied to the lower winding of relay CTP which holds wit left contacts closed. The relay driver circuit is restored, i.e., transistor Q4 conducting, at the end of the counter output pulse. Since this pulse lasts a full clock pulse, device CT picks up and contact 3 closes as energy is restored to terminal 7. Thus the upper winding of relay CTP is reenergized as the new counting period starts. This relay therefore holds or is retained in its left position for one and half code periods or, as previously described, blanks out any operation during the half cycle when contact 4 is closed. Since the next output pulse from counter 12 occurs with contact 4 open and contact 3 closed, it is the upper winding of relay CTP that is not energized. This relay then holds or is retained in its right position for the 1½ cycles of the code rate, blanking out the opposite half cycle when contact 3 is closed. Said in another way, the operation of relay CTP is controlled by the pulse filler arrangement to alternately blank out opposite periods of the operation of device CT every X cycles or counts of the code rate.

Figure 2:
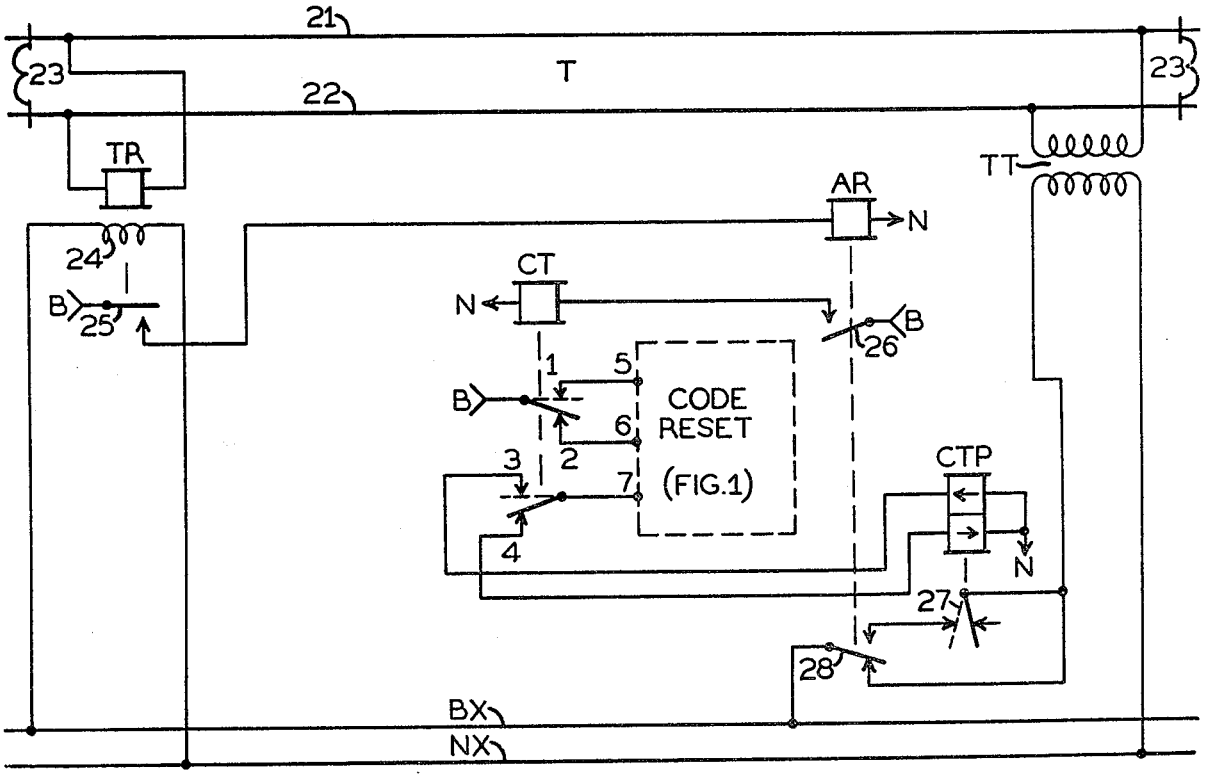
FIG. 2 is a schematic circuit diagram illustrating the use of the reset apparatus of FIG. 1 in a railroad track circuit.

A specific use of the apparatus of FIG. 1 is illustrated in FIG. 2. Shown across the top is a stretch of railroad track with rails 21 and 22. A track section T is insulated or set off from the remainder of the stretch by insulated joints 23. This section is provided with an AC track circuit which includes track transformer TT and a two winding, vane type AC track relay TR. Energy for the track circuit is obtained at each location from the previously described line wires BX and NX shown across the bottom of FIG. 2. At one end, the track winding of relay TR, shown by conventional symbol, is connected across the section rails 21 and 22. The local winding 24 of this relay is connected across lines BX and NX. At the other end, the secondary winding of transformer TT is connected across rails 21 and 22. The transformer primary winding is normally connected across lines BX and NX over back contact 28 of an approach relay AR so that the rails are supplied with steady AC energy. When relay TR releases, its back contact 25 connects the winding of relay AR across the DC source and relay AR picks up. The closing of front contact 26 of relay AR energizes code transmitter CT which is the same as or similar to device CT of FIG. 1. Front contacts 1 and 3 and back contacts 2 and 4 of transmitter CT are shown below the winding symbol in a manner equivalent to the similar contacts in FIG. 1. Each pair is alternately closed when device CT is energized and operating. A conventional dashed block with terminals 5, 6, and 7 designates the already described code reset apparatus of FIG. 1. When relay AR picks up, it also shifts the BX connection of the primary of transformer TT to include front contact 28 of relay AR and left contact 27 of relay CTP. Since relay CTP repeats the code rate of device CT, transformer TT and thus the section rails are supplied with coded energy under this situation.

The track circuit apparatus is shown in its normal condition with section T unoccupied. Steady AC energy is applied to the rails through transformer TT and flows to the track winding of relay TR. The circuit is adjusted so that sufficient phase angle exists between the track and local winding currents to cause vane relay TR to pick up. Relay AR and thus device CT are deenergized. Although the lower winding of relay CTP is energized, this has no effect on operation since back contact 28 bypasses contact 27. When a train enters section T and shunts the rails, relay TR releases and energizes relay AR. This latter relay picks up, energizing transmitter CT and shifting transformer TT connections to include left contact 27 of relay CTP. With device CT active, relay CTP is driven to alternately close its left and right contacts. Coded AC energy with a 50% duty cycle, i.e., equal on and off periods, is supplied to the rails to control cab signal or similar apparatus on board the train in any known manner. As already discussed, relay CTP is controlled to periodically hold in its left to right position to blank out a code pulse, i.e., a half cycle of the code rate. As specifcally shown, when this relay holds left, a longer energy-on period results in the rails which is three times the length of the usual on period. When the relay holds right, a similar energy off period results. However, in practice, other contact pairs of relay CTP will be used with adjacent or parallel track circuits with energy supplied over right contacts. With slightly modified track connections, one usual style CTP relay can control eight track circuits. These periodic long on or off periods have no effect on train carried apparatus.

When the train clears section T, assuming no other reset arrangement, relay TR does not respond to the normal track code now flowing in the rails. In other words, relay TR receives insufficient energy during a normal code on-period to open its back contact 25. However, the first periodic long energy-on period, as controlled by the pulse filler apparatus, does supply enough energy for relay TR to respond and open ts back contact 25. This deenergizes relay AR which immedately releases to supply steady energy to the rails over its back contact 28. Relay TR then completes its response by fully picking up to reset the track circuit. Transmitter CT is also deenergized and halts its coding operation. This completes the restoration of the normal condition shown in the drawing.

Although I have herein shown and described but one specific arrangement of the code reset apparatus embodying the invention and one specific use thereof, it is to be understood that various changes and modifications therein within the scope of the appended claims may be made without departing from the spirit and scope of my invention.

Having thus described my invention, what I claim and desire to protect by Letters Patent, is:

1. In a track circuit for a railroad track section, including an alternating current energy source coupled to the rails at one end of said section for normally supplying steady energy through said rails, a track relay connected to said rails at the other end of said section and responsive only to steady energy received through said rails for registering an unoccupied section, and a code transmitter means controlled by said track relay to be activated when a train occupies said section, reset apparatus comprising, (a) a counting means operable for counting successive input clock pulses and responsive to a preselected total count for generating an output pulse of clock pulse duration and resetting to initiate a new count, (b) a first switching means coupled to said counting means and operable for alternately producing continuous first or second gating signals in response to reception of successive output pulses from said counting means, (c) a first and a second gate means controlled by said first switching means to be alternately enabled by said first and second gating signals, respectively, (d) each gate means coupled for alternately receiving code pulses a the code rate of said code transmitter means, when active, and operable when enabled for applying corresponding clock pulses successively to said counting means, (e) a repeater relay having two control windings and operable alternately between first and second positions only as said windings are alternately energized, and (f) driver circuit means controlled by said counting means and coupled by said code transmitter means when active for normally alternately energizing said repeater relay windings and responsive to the reception of an output pulse from said counting means for inhibiting the energization of the repeater relay winding then coupled by said code transmitter means to hold said repeater relay in its existing position during that and the next subsequent clock pulse periods, (g) said repeater relay further coupled when a train occupies said section for coding the energy supplied by said source to said section rails, said coded energy being periodically modified at the end of each preselected total count by a lengthened energy pulse to which said track relay responds when said section is unoccupied to restore the supply of steady energy to said rails.

2. Reset apparatus as defined in claim 1 in which, (a) said first switching means is a flip-flop element having its clock input connected to the output of said counting means and operable for alternately activating a first and a second gating signal output as output pulses are successively applied from said counting means, (b) each gate means is a two input NAND logic element with one input coupled to different one of said signal outputs of said flip-flop element and enabled when that output is not activated, and (c) the other input of each NAND element is coupled to receive alternate code pulses from said code transmitter means.

3. Reset apparatus as defined in claim 1 which further includes, a second switching means controlled by said code transmitter means when active and coupled for supplying clock pulses alternately to said first and second gate means, each series of applied clock pulses being at the code rate of said code transmitter means.

4. Reset apparatus as defined in claim 3 in which, (a) each switching means is a flip-flop element, (b) the clock input of said first switching flip-flop element is connected to the output of said counting means and that element is operable for alternately activating a first and second gating signal output as output pulses are successively applied from said counting means, (c) said second switching flip-flop element is coupled to said code transmitter means for providing clock pulses alternately at its first and second outputs, each series of output signals being at the code rate of and representing opposite conditions of said code transmitter means, (d) each gate means is a two input NAND logic element having one input coupled to receive a different gating signal from said first flip-flop element so that said first and second NAND elements are alternately enabled, (e) the other input of each NAND element is connected to a different output of said second flip-flop element for receiving the corresponding clock pulses, and (f) said NAND elements alternately supply a series of clock pulses to said counting means equalling said selected total count.

5. Reset apparatus as defined in claims 1 or 4 in which said driver circuit means comprises, (a) a source of local operating energy, (b) an optical coupler device including a light emitter and a light responder, (c) a buffer transistor, coupled to said counting means, normally biased to a conducting condition and responsive to an output pulse for shifting to a non-conducting condition for the duration of that pulse, (d) said buffer transistor further connected for energizing the light emitter portion of said optical coupler to activate the associated light responder portion when that transistor is in conducting condition, and (e) a relay driver transistor biased to a conducting condition when said buffer transistor is conducting, and in which, (f) said repeater relay is coupled to said operating source jointly by said code transmitter means and said driver transistor for alternately energizing its two windings when said transmitter means is active and said driver transistor is in a conducting condition, and (g) said driver transistor interrupts the supply of operating energy to said repeater relay during each output pulse from said counting means.

6. A track circuit arrangement for a railroad track section, comprising, (a) an alternating current energy source coupled to the rails at one end of said section for normally supplying steady energy through said rails, (b) a track relay coupled to said rails at the other end of said section and responsive to the presence or absence of steady energy in the rails for registering an unoccupied or an occupied section, respectively, (c) a code transmitter controlled by said track relay and activated by the registry of an occupied section for operating between first and second positions at a predetermined code rate, (d) a two winding repeater relay operable between first and second positions only when said windings are alternately energized, (1) said repeater relay controlling the coupling between said source and said rails in response to the registry of an occupied section for supplying coded energy through the rails to which said track relay is non-responsive, (e) a counter means operable for counting a series of input clock pulses and responsive to a preselected total count for generating an output pulse of clock pulse duration and resetting to initiate a new count, (f) a two channel gate means controlled by said code transmitter and coupled for supplying a series of clock pulses at said code rate to said counter means when either channel is enabled, (g) a first switching means coupled to said gate means and controlled by said counter means for alternately enabling said gate means channels in response to each output pulse until the next subsequent output pulse is generated, and (h) a driver circuit network coupled by said code transmitter for normally alternately energizing the windings of said repeater relay at said code rate to transmit coded energy through said rails, (i) said driver network also controlled by said counter means and responsive to each output pulse for inhibiting energization of the winding then coupled for the duration of said pulse, whereby the operation of said repeater relay is modified to periodically transmit an extended code pulse of energy through said rails to which said track relay responds after a train clears to register an unoccupied section and thus reset the track circuit.

7. A track circuit arrangement as defined in claim 6 in which, (a) said first switching means is a flip-flop circuit element having its clock input coupled to receive said output pulses from said counter means and responsive thereto for alternately supplying first and second gating signals as successive output pulses are received, and (b) said two channel gate means comprises a first and a second two-input NAND logic element, (1) one input of each first and second NAND element coupled for receiving said first or second gating signal, respectively, and enabled only when the corresponding signal is received, (2) the other input of each first and second NAND element coupled for receiving a series of code pulses representing the operation of said code transmitter to its first and second positions, respectively, (c) each NAND element is separately coupled for supplying a series of clock pulses to said counter means representing the operation of said code transmitter only when that NAND element is enabled by the corresponding gating signal.

8. A track circuit arrangement as defined in claim 6 or 7 in which said driver circuit network comprises, (a) a source of local operating energy, (b) an optical coupler device including a light emitter and a light responder, (c) a buffer transistor, coupled to said counter means, normally biased to a conducting condition and responsive to an output pulse from said counter means for shifting to a non-conducting condition for the duration of that pulse, (d) said buffer transistor further connected for energizing the light emitter portion of said optical coupler to activate the associated light responder when that transistor is in a conducting condition, and (e) a relay driver transistor normally biased to a conducting condition when said buffer transistor is conducting, and in which, (f) said repeater relay is coupled to said operating source jointly by said code transmitter and said driver transistor for alternately energizing its two windings when said code transmitter is active and said driver transistor is in a conducting condition, and (g) said driver transistor interrupts the supply of operating energy to said repeater during each output pulse from said counter means.

* * * * *